United States Patent [19]

Bailey

[11] Patent Number: 4,927,997

[45] Date of Patent: May 22, 1990

[54] HEAT TRANSFER PAD

[75] Inventor: Samuel Bailey, Fairfield, Ohio

[73] Assignee: Beta Development Group, Inc., Lexington, Ky.

[21] Appl. No.: 266,137

[22] Filed: Nov. 2, 1988

[51] Int. Cl.[5] ..... H05B 3/72

[52] U.S. Cl. ..... 219/459; 219/456; 126/215

[58] Field of Search ..... 219/459, 433, 430, 432, 219/429, 456; 126/211, 215, 214 C, 214 D, 221

[56] References Cited

U.S. PATENT DOCUMENTS

| | | | |
|---|---|---|---|
| 469,597 | 2/1892 | Reid | 126/215 |
| 1,109,323 | 9/1914 | Cruickshank | 126/215 |
| 1,386,303 | 8/1921 | Armstrong . | |
| 1,566,185 | 12/1925 | Elmgren | 219/459 |
| 2,400,508 | 5/1946 | Hermann | 126/215 |
| 2,565,726 | 8/1951 | Garrison | 126/215 |
| 3,083,286 | 3/1963 | Swetlitz . | |
| 3,569,672 | 3/1971 | Hurko | 219/464 |
| 3,845,273 | 10/1974 | Hurko | 219/462 |
| 4,634,841 | 1/1987 | Laughrey | 219/464 |

FOREIGN PATENT DOCUMENTS

| | | | |
|---|---|---|---|
| 54-20441 | 2/1979 | Japan | 219/10.493 |

*Primary Examiner*—Teresa J. Walberg
*Attorney, Agent, or Firm*—King & Schickli

[57] ABSTRACT

A flexible heat transfer pad includes a metallic thermally conducting disc covering the burner element. An annular retaining ring is provided to retain and center the disc on the burner element. The retaining ring includes a downwardly depending skirt to substantially close the stove opening. Inner downwardly depending tabs are provided to contact the stovetop reflector pan, thereby securely retaining the pad in place. An annular expansion joint is provided in the annular ring to accommodate thermal expansion/contraction of the disc. One or more circular grooves are provided on both the upper and lower surfaces of the disc to enhance the flexibility and resist any tendency to buckle due to thermal stresses.

10 Claims, 1 Drawing Sheet

HEAT TRANSFER PAD

TECHNICAL FIELD

The present invention relates generally to a heat transfer apparatus and, more particularly, to a heat transfer pad adapted to be removably mounted on a burner element, as found on electric stoves, to facilitate improved heat transfer.

BACKGROUND OF THE INVENTION

Electric ranges are commonly used in a large number of homes worldwide. Typically, the electric range includes a stove top having four or more coiled electrical resistance heating elements, commonly known as burners. During use, cooking vessels, such as pots, pans, kettles and the like are placed on the coiled burner element. The electrical resistance generated heat from the burner is then utilized for cooking.

During the cooking process on a standard burner of this type, a large amount of heat is lost to the surroundings. This occurs through convection and radiation losses from underneath and around the open burner element. Additionally, effective conduction of heat, the most efficient mode of transfer, occurs only in the places where actual physical contact is made between the coiled burner element and the cooking vessel. Physical contact is sometimes severely limited by unevenness of the underside of the cooking vessel. Furthermore, because there are substantial void spaces in the element, the heat conduction efficiency is reduced even more. In the areas where there is no contact, either by surface unevenness or simply due to open space between the coils, heat transmission occurs only through radiation and/or convection, both of which are inferior to conduction. The above situation is sometimes referred to as contact resistance. Practical disadvantages of contact resistance are greater use of energy through the requirements of longer cooking times and cooking at higher temperature settings to achieve the desired cooking result.

U.S. Pat. Nos. 3,569,672 and 3,845,273, both to Hurko, disclose devices including composite metal plate heating units. The upper heat transfer plate is permanently attached to the coiled burner element, and the unit is intended to totally replace the standard burner.

These heating units, while improving heat transmission qualities are thus not without their drawbacks. For example, when the burner elements burn out, the entire unit must be replaced, at great expense to the consumer. Also, since the plate that provides the upper heating or cooking surface is integral with the remainder of the unit, there is little or no flexibility. Removal for efficient cleaning of spills of food, or simply to use as a retrofit on another burner element, is not possible.

A need exists therefore for a stove top heat transfer pad to optimize the heat transfer characteristics of a stove top burner element that is removably mounted on the burner element. The pad should be simple in design, easy to install and remove for cleaning, and economical to produce.

SUMMARY OF THE INVENTION

It is therefore a primary object of the present invention to provide a heat transfer pad overcoming the limitations and disadvantages of the prior art.

Another object of the present invention is to provide a heat transfer pad to improve heat conduction between a stove top burner and the cooking vessels being used.

Still another object of the present invention is to detachably separate it from the burner element to provide a heat transfer pad which is easily installed and removed from the heating element of any stove.

Yet another object of the present invention is to provide a heat transfer pad that is relatively flat but is flexible to present an upper cooking surface that provides a uniform cooking surface throughout the entire range of cooking temperatures.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a heat transfer pad provides efficient heat transfer between a standard stove top burner element and a cooking vessel. During cooking, the heat transfer pad heats uniformly, thereby greatly improving the heat transfer from the burner element to the cooking vessel, over the standard units in use today.

The preferred embodiment of the heat transfer pad selected to illustrate the invention includes a central metal disc within an annular retaining ring. The disc is fabricated from copper to provide flexibility when heated and optimum heat transfer characteristics. The retaining ring is fabricated of stainless steel to provide maximum strength and durability.

According to an important aspect of this invention, the disc is held within the retaining ring by an annular slip joint. Advantageously, this slip joint allows substantially unrestricted expansion/ contraction of the disc relative to the retaining ring during heating/cooling of the burner. This feature allows the retaining ring to be fabricated of the stronger stainless steel even though it has a different coefficient of linear expansion. There is no tendency of warping due to a buildup of internal thermal stresses, as would be found if a solid joint were used.

The disc further includes a set of concentric grooves cut into both the upper and lower surfaces to provide increased flexibility and improve the ability of the disc to mate with the bottom of the cooking vessel for maximum heat transfer. These grooves are also provided to accomodate internal stresses due to thermal expansion, and thus negate any tendency for buckling. In this manner, a substantially flat, but flexible surface for heating the cooking vessel is provided. Maximum surface contact between the pad and the cooking vessel is therefore assured.

During operation, the heat due to the electrical resistance within the burner element is transferred to the copper disc. Being essentially homogeneous, the disc spreads the heat from the element evenly throughout its surface. In this manner, the disc operates essentially as a very effective collector and transfer means. Because the surface of the disc remains flexible, but is substantially uniform and flat, maximum contact between the surface of the cooking vessel and the disc is assured. In this way, maximum cooking potential is assured by reducing contact resistance to a minimum.

A depending skirt integral with the ring extends outwardly and downwardly from the retaining ring. This skirt is provided to substantially close the area between the heating elements and the stove top. A rolled edge at the bottom of the skirt is in close proximity to the stove top to form the enclosure. In this manner, the skirt substantially prevents side losses due to radiation and convection. The heat which normally would be lost through this gap is then redirected towards the disc, enhancing efficiency.

A set of spaced tabs depend downwardly from the retaining ring. These tabs are provided to locate the heat transfer pad centrally over the heating element. The outer face of the tabs engage the upper lip of the burner reflector pan, simplifying installation and centering. The pad is held against any lateral movement during use.

To prevent any pitting or corrosion due to the high temperatures encountered during cooking, the disc is plated with an electrolysis nickel plating. This plating is very thin (3–5 microns) so as not to restrict the flexibility of the disc. The plating prevents discoloration and maintains the aesthetically pleasing shiny finish.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
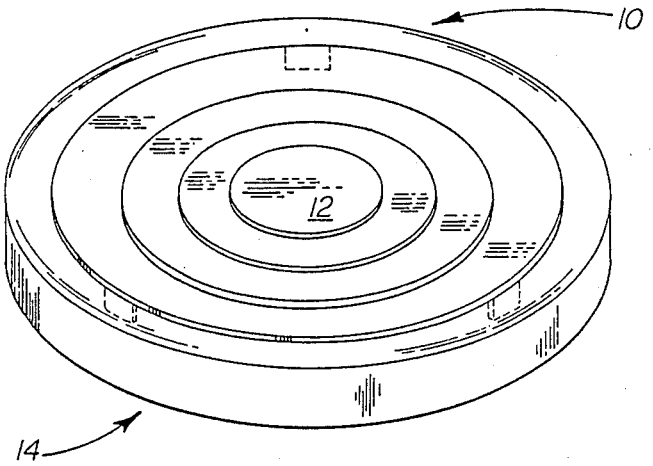
FIG. 1 is a perspective view of the heat transfer pad of the present invention.

Reference is now made to FIG. 1 showing the heat transfer pad of the present invention particularly adapted to be removably mounted on the burner element of a stove. During cooking, the apparatus of the present invention acts as an effective heat collector and transfer means to provide heat uniformly to the entire bottom surface of the cooking vessel. This increases the efficiency of the burner and lowers operating costs, as will be seen more in detail below.

Figure 2:
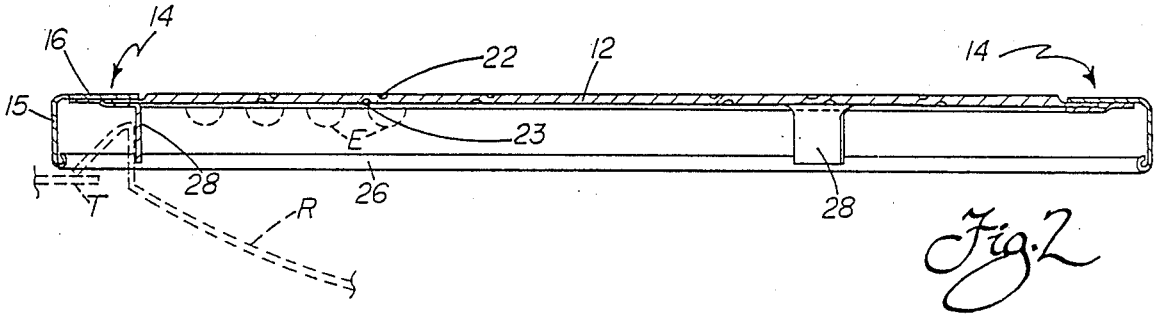
FIG. 2 is a cross sectional view of the heat transfer pad of the present invention removably mounted on a burner element; the stove top, reflector, and burner element being shown in phantom.

As shown in FIGS. 1 and 2, the heat transfer pad 10 is circular, and is designed to cover the coiled heating element E of an ordinary cooking stove. To form the heat transfer pad 10, a flexible metallic disc 12 is provided within an annular retaining ring 14. In the preferred embodiment, the disc 12 is fabricated from copper to provide an optimum heat transfer coefficient and to provide a desired degree of flexibility, thus lessening contact resistance. Copper is a relatively soft metal, and at cooking temperatures becomes even more flexible, further lessening contact resistance and enhancing performance. In the preferred embodiment, 12 GA (0.0641 inch) ASTM B-152 Alloy 110 is used to provide the optimum balance between flexibility and strength.

The retaining ring 14 is fabricated of stainless steel to provide maximum strength and durability. The preferred alloy and gauge is AISI 304, Type 3 P.O.S.; 26 Ga. (0.018 inch).

Figure 3:
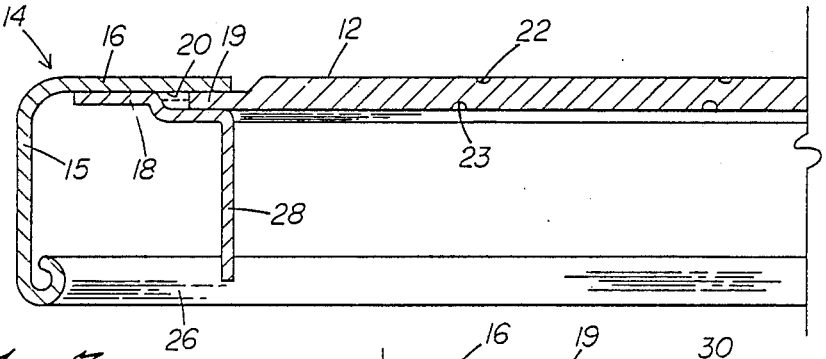
FIG. 3 is an enlarged, partial cross sectional view illustrating the slip joint of the heat transfer pad of the present invention.

As shown in FIGS. 2 and 3, the composite retaining ring 14 comprises an annular skirt 15 with an annular upper extension 16 extending substantially in the plane of the upper surface of the disc 12. Inside the skirt 15 is an annular retainer 18 connected to the underside of the extension 16 by a rolled seam or spot weld. The two parts are previously separately embossed or stamped from metal sheet stock. This technique simplifies fabrication and assembly, advantageously lowering production costs.

According to an important aspect of this invention, the disc 12 is held within the retaining ring 14 by an annular slip joint 20 (see FIG. 3). This slip joint 20 is created by the spacing between the annular extension 16 and the offset portion of the annular retainer 18 that is slightly larger than mating outer rim 19 of the disc 12. A radial "free space" is provided between the opposed edges of the rim 19 and the retaining ring 14. Advantageously, the slip joint 20 accomodates substantially unrestricted thermal expansion/contraction of the disc 12 relative to the retaining ring 14 during heating/cooling. This allows the flexibility of the disc 12; and any build-up of internal thermal stresses, tending to cause buckling or warping of the disc 12, to be avoided.

As shown in FIGS. 1 and 2, the disc includes a set of concentric circular grooves 22, 23 cut into both the upper and lower surfaces, respectively. The grooves 22, 23 are provided to enhance the flexibility of the disc 12 and to accomodate internal stresses within the disc 12 due to thermal expansion or contraction. The grooves are offset radially so as to prevent undue weakening of the cross sectioned strength of the disc. Especially as the heat builds up in the disc 12 due to cooking temperatures, the annular reduced sections between the grooves 22, 23 (see FIG. 3) flex easier not only allowing better contact with the bottom of the cooking vessel, but also accomodating stress due to any momentary uneven heating.

Thus, it can be seen that especially working in concert, the provision of the annular slip joint 20 and the circular grooves 22, 23 in the surface of the disc 12 advantageously negates tendency for contact resistance to develop when using the heat transfer pad 12 of the present invention. A substantially flat surface that is flexible for substantially full contact with the bottom of the cooking vessel and maximum heat transfer for heating said cooking vessel is assured in a manner not previously attainable.

During cooking, the heat generated by the coiled burner element E is constantly being transferred to the disc 12. Being essentially homogeneous, the disc 12 spreads the heat from the element evenly throughout the surface. In this manner, the disc 12 operates essentially as a very effective heat collector and transfer means. Because the surface of the disc 12 includes no gaps, another major cause of contact resistance is eliminated.

As shown in FIGS. 2 and 3, depending skirt 15 serves to substantially enclose the area around the burner element E by closely fitting around stove top T and reflector pan R (shown in phantom on FIG. 2). It can be seen that when the heat transfer pad 10 is so installed on the stove, the loss of heat around the edge is minimized providing more heat for effective cooking. That is, the skirt 15 in effect substantially prevents losses due to radiation and convection throughout the cooking process. The heat which is normally lost through the gap on the standard stove around the burner is then redirected by the reflector pan R towards the disc 12, enhancing efficiency.

The skirt 15 terminates in a rolled lip 26 that forms the close fit. The flexibility of the disc 12 interacting with the slip joint 20 assures that the disc 12 is maintained in engagement with the heating element E, especially under the weight of a cooking vessel. The lip 26 provides strength to the as and further resists any tendency of the skirt 15 to warp during heating or cooling. The lip also eliminates any sharp edge for ease of handling and cleaning. As shown in FIGS. 2 and 3, the retainer 18 of the retaining ring 14 includes multiple depending tabs 28. The tabs 28 are provided to locate the pad 10 centrally over the burner element E. As shown in FIG. 2, the tabs 28 contact the inside upper lip of the reflector pan R centering the pad 10 and effectively resisting any lateral movement.

Figure 4:
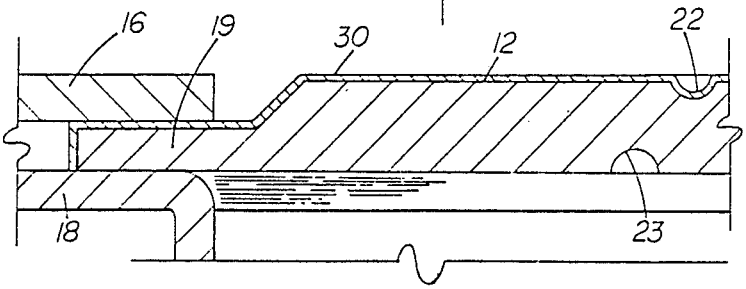
FIG. 4 is a further enlarged, partial cross sectional view illustrating the slip joint in greater detail and the electrolysis nickel plating on the surface of the disc.

To prevent any pitting or corrosion of the disc 12 due to the high temperatures encountered during cooking, the upper surface of the disc 12 is preferrably provided with an electrolysis nickel plating 30 (see FIG. 4). The plating is relatively thin (3 to 5 microns) preventing any appreciable restriction of the flexibility of the pad 10. The combination of the nickel plating on the disc 12, and the polished stainless steel ring 14 around the periphery of the pad provides for easy cleaning and maintenance, as well as an aesthetically pleasing addition to any stove.

In summary, numerous benefits result from employing the concepts of the present invention. The heat transfer pad 10 is adapted to be readily installed over the existing burner element E of a standard cooking stove. The pad 10 includes a flexible metallic disc 12 which acts as a very effective heat collector and transfer means, providing a uniform heating surface and optimizing heat transfer between the disc 12 and the cooking vessel. Advantageously, this serves to greatly reduce heat loss, improving the efficiency of the stove and reducing cooking times. A slip joint 20 between the retaining ring 14 and the rim 19 of the disc 12, enhances flexibility and prevents buckling. The offset grooves 22, 23 also assist in these functions. The nickel plating 30 maintains the flexibility and provides a maintenance-free and attractive cooking surface.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A heat transfer pad for optimizing heat transfer between an electric stove burner element and a cooking vessel, comprising:

a thermally conducting, relatively flexible disc for collecting and transferring heat, said flexible disc providing a heating surface for direct contact with a cooking vessel, said disc being provided with upper and lower surfaces, said upper and lower surfaces both being flexible; and ring means for retaining said pad on a burner element, said ring means including thermal expansion accommodating means for said pad.

2. The heat transfer pad of claim 1, wherein a plurality of concentric, circular grooves are formed in said upper and lower surfaces for enhanced flexibility and accommodation of thermal expansion.

3. The heat transfer pad of claim 1, wherein said ring means includes depending tabs to locate said pad with respect to the burner element.

4. The heat transfer pad of claim 3 wherein said ring means further includes a depending skirt to assist in retaining the heat.

5. The heat transfer pad of claim 1 wherein said thermal expansion accomodating means is a slip joint for receiving said disc and allowing substantially unrestricted thermal expansion/ contraction of said disc relative to said ring means.

6. The heat transfer pad of claim 5 wherein said ring means includes a depending skirt, an extension of the skirt extending in substantially the plane of the upper surface of said disc, an annular retainer connected to said extension and providing a space therewith slightly larger than the outer rim of said disc, to thereby form said slip joint.

7. The heat transfer pad of claim 6 wherein said pad includes a relatively thin outer layer of nickel plating.

8. The heat transfer pad of claim 1 wherein said ring means is fabricated of stainless steel.

9. The heat transfer pad of claim 4 wherein said depending skirt terminates in a rolled lip.

10. The heat transfer pad of claim 1 wherein said disc is copper.

* * * * *